US009377233B2

(12) United States Patent
Boehringer et al.

(10) Patent No.: US 9,377,233 B2
(45) Date of Patent: Jun. 28, 2016

(54) ICE MAKER FOR FRENCH DOOR BOTTOM MOUNT REFRIGERATOR

(71) Applicant: Whirlpool Corporation, Benton Harbor, MI (US)

(72) Inventors: Bruno A. Boehringer, Saint Joseph, MI (US); Roberto H. Pereira, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 423 days.

(21) Appl. No.: 13/826,416

(22) Filed: Mar. 14, 2013

(65) Prior Publication Data

US 2014/0260407 A1 Sep. 18, 2014

(51) Int. Cl.

| | |
|---|---|
| ***F25C 5/00*** | (2006.01) |
| ***F25D 23/00*** | (2006.01) |
| ***F25D 23/12*** | (2006.01) |

(52) U.S. Cl.

CPC ..... *F25C 5/007* (2013.01); *F25C 5/005* (2013.01); *F25D 23/006* (2013.01); *F25D 23/126* (2013.01); *F25D 2323/021* (2013.01)

(58) Field of Classification Search

CPC ..... F25D 2323/02; F25D 2323/021; F25D 23/06; F25D 23/126; F25C 1/00; F25C 5/18; F25C 5/185; F25C 5/007

See application file for complete search history.

(56) References Cited

U.S. PATENT DOCUMENTS

| | | | | |
|---|---|---|---|---|
| 2,489,009 | A | 11/1949 | Corhanidis | |
| 2,914,927 | A | 12/1959 | Corhanidis | |
| 3,133,427 | A | 5/1964 | Petkwitz | |
| 6,401,461 | B1 | 6/2002 | Harrison | |
| 6,964,177 | B2 * | 11/2005 | Lee | F25C 5/005 62/320 |
| 2008/0092574 | A1 * | 4/2008 | Doberstein | 62/233 |
| 2008/0134708 | A1 * | 6/2008 | Lee et al. | 62/340 |
| 2009/0031750 | A1 | 2/2009 | Whillock, Sr. | |
| 2010/0018223 | A1 | 1/2010 | Sundhar | |
| 2011/0100039 | A1 * | 5/2011 | Kim et al. | 62/139 |
| 2011/0259034 | A1 * | 10/2011 | Wang et al. | 62/344 |
| 2012/0006047 | A2 * | 1/2012 | Anselmino et al. | 62/344 |

FOREIGN PATENT DOCUMENTS

WO 2010051610 A3 5/2010

* cited by examiner

*Primary Examiner* — Cassey D Bauer

(57) ABSTRACT

A dedicated, hermetically sealed ice maker is provided. The ice maker includes a compartment including an ice tray and an ice bin disposed at least partially in the compartment. A dedicated ice maker circuit is disposed at least partially within the compartment and includes a microcompressor, condenser, expansion device, and evaporated. The dedicated circuit is used to cool air inside the ice maker compartment for forming ice in the ice tray in the compartment and for preventing melting of formed ice cubes in the ice bin. The ice maker may be used within or outside of a refrigerator. When used within the refrigerator, the ice maker will have its own dedicated hermetically sealed unit, including the plurality of thermally insulated walls. The ice maker may also be connected to a dispenser of a refrigerator for dispensing the formed ice.

23 Claims, 6 Drawing Sheets

ICE MAKER FOR FRENCH DOOR BOTTOM MOUNT REFRIGERATOR

FIELD OF THE INVENTION

The invention relates generally to refrigerators. More particularly, but not exclusively, the invention relates to a refrigerator ice maker that includes its own dedicated refrigeration circuit.

BACKGROUND OF THE INVENTION

Bottom mount refrigerators include a freezer compartment on the bottom, with the fresh food or refrigerator compartment above the freezer compartment. One or more doors provide access to the fresh food compartment, and a separate door provides access to the freezer compartment. The freezer door or doors may be drawer-type doors that are pulled out, or they may be hingedly connected similar to the refrigerator compartment doors, such that they are rotated to provide access within.

In many current bottom mount style refrigerators, cold air from the freezer compartment is used to produce ice in a conventional ice maker located at one of the refrigerator doors. To transfer the cold air from the freezer to the ice maker, air ducts and a fan or fans are used. As such, the overall energy efficiency of the refrigerator is reduced because part of the cold air is used to make ice, and not to cool the freezer compartment.

In addition, the ice making efficiency is reduced due to the heat gained on the air path from the freezer compartment to the ice maker tray. There is also increased condensation at the back panel of the refrigerator due to the ice maker air duct being located close thereto. Another issue can arise if the gaskets installed in the ice box assembly of the ice maker are faulty, and allow air leakage. The cold air from the freezer can leak into the refrigerator compartment, thus having the possibility of freezing the items in the compartment.

Therefore, there is a need in the art for a method and apparatus for cooling water in an ice maker to create ice, that does not utilize the at or below freezing air from the freezer compartment. There is also a need for a method of making ice that reduces the condensation on the outside of the refrigerator, and reduces the risk of allowing the cold air to leak into other compartments of the refrigerator.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide an ice maker with its own dedicated refrigeration circuit to cool water to form ice.

It is yet another object, feature, and/or advantage of the present invention to provide a modular ice maker that can be removed from the refrigerator.

It is a further object, feature, and/or advantage of the present invention to reduce the energy usage for a refrigerator.

It is still another object, feature, and/or advantage of the present invention to increase the ice making efficiency of an ice maker.

It is yet a further object, feature, and/or advantage of the present invention to limit or prevent external condensation of a refrigerator.

It is still a further object, feature, and/or advantage of the present invention to provide an alternative heating source for the flipper mullion region of the refrigerator.

These and/or other objects, features, and advantages of the present invention will be apparent to those skilled in the art. The present invention is not to be limited to or by these objects, features and advantages. No single embodiment need provide each and every object, feature, or advantage.

According to an aspect of the invention, an ice maker is provided. The ice maker includes an ice maker compartment, with an ice tray and ice bin disposed at least partially within the ice maker compartment. A circuit is also disposed at least partially within the compartment, and includes a microcompressor, condenser, expansion device, and evaporator.

According to another aspect of the invention, a refrigerator is provided. The refrigerator includes a refrigerator cabinet, with a door for providing access to a compartment within the refrigerator cabinet. An ice maker is mounted in the compartment, with the ice maker comprising an ice tray and an ice bin. A circuit is disposed within the ice maker for cooling the ice maker, and includes a microcompressor, condenser, expansion device, and evaporator. The ice maker may also be a hermetically sealed unit that can be optionally removed from the refrigerator and used external of the refrigerator.

According to yet another aspect of the invention, a refrigerator is provided. The refrigerator includes a refrigerator cabinet, and a door for providing access to a compartment within the refrigerator cabinet. A modular ice maker is mounted on the door, the ice maker comprising a water tray and an ice bin. A circuit is disposed within the ice maker for cooling the ice maker, the circuit comprising a microcompressor, condenser, expansion device, and evaporator. The ice maker is operable both in the refrigerator and outside the refrigerator.

According to still a further aspect of the invention, a refrigerator is provided. The refrigerator includes a refrigerator cabinet, and a door for providing access to a compartment within the refrigerator cabinet. An ice maker is mounted in the compartment and comprises an ice tray and an ice bin. The ice maker is hermetically sealed within the compartment. A circuit is disposed within the ice maker for cooling the ice maker. The circuit comprises a microcompressor, condenser, expansion device, and evaporator.

DETAILED DESCRIPTION OF THE PREFERRED EMBODIMENTS

Figure 1:
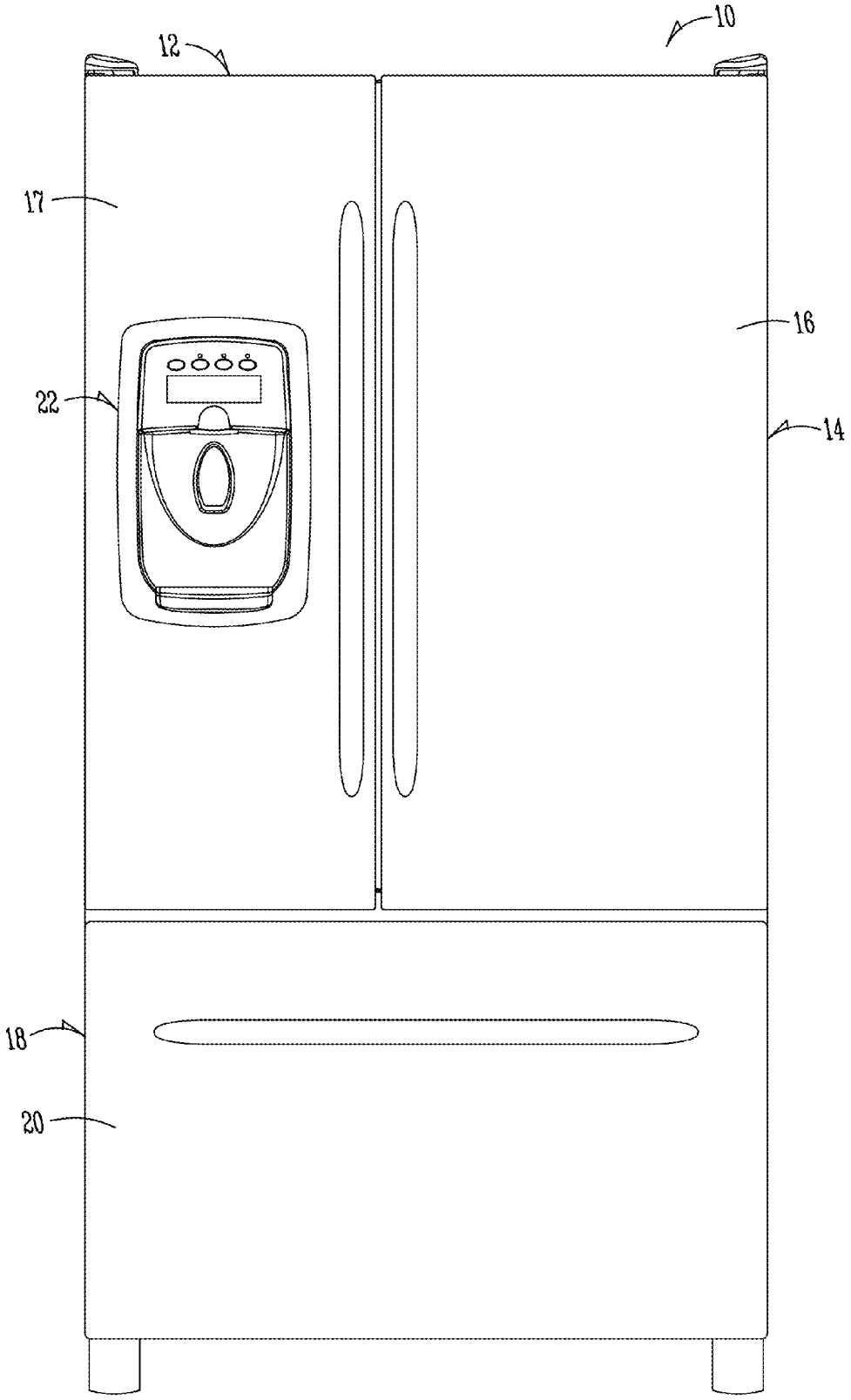
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 14. A dispenser 22 is shown to be positioned on one of the doors 16, 17 of the refrigerator compartment 14. The dispenser may be a water dispenser, ice dispenser, other beverage dispenser, or some combination thereof. Furthermore, the dispenser may be placed on any door of the refrigerator 10, or in the alternative, the dispenser 22 may be placed within one of the compartments of the refrigerator 10. For example, the dispenser 22 may be placed at one of the interior walls of the refrigerator compartment 14, thus being part of the cabinet. The placement of the dispenser 22 is not to limit the present invention. Positioned generally below the refrigerator compartment 14 is a freezer compartment 18. A freezer door 20 provides access to within the freezer compartment 18. The freezer door of FIG. 1 is shown to be a drawer type door, however, the present invention contemplates that the freezer door may be a drawer, a hinged door, multiple doors, or some combination thereof.

It should also appreciated that, while the figures show a bottom mount style refrigerator 10, the present invention contemplates that any style of a refrigerator be included as part of the invention. The figures merely depict one example of a type of refrigerator 10 that can be used with the components with the present invention.

Figure 2:
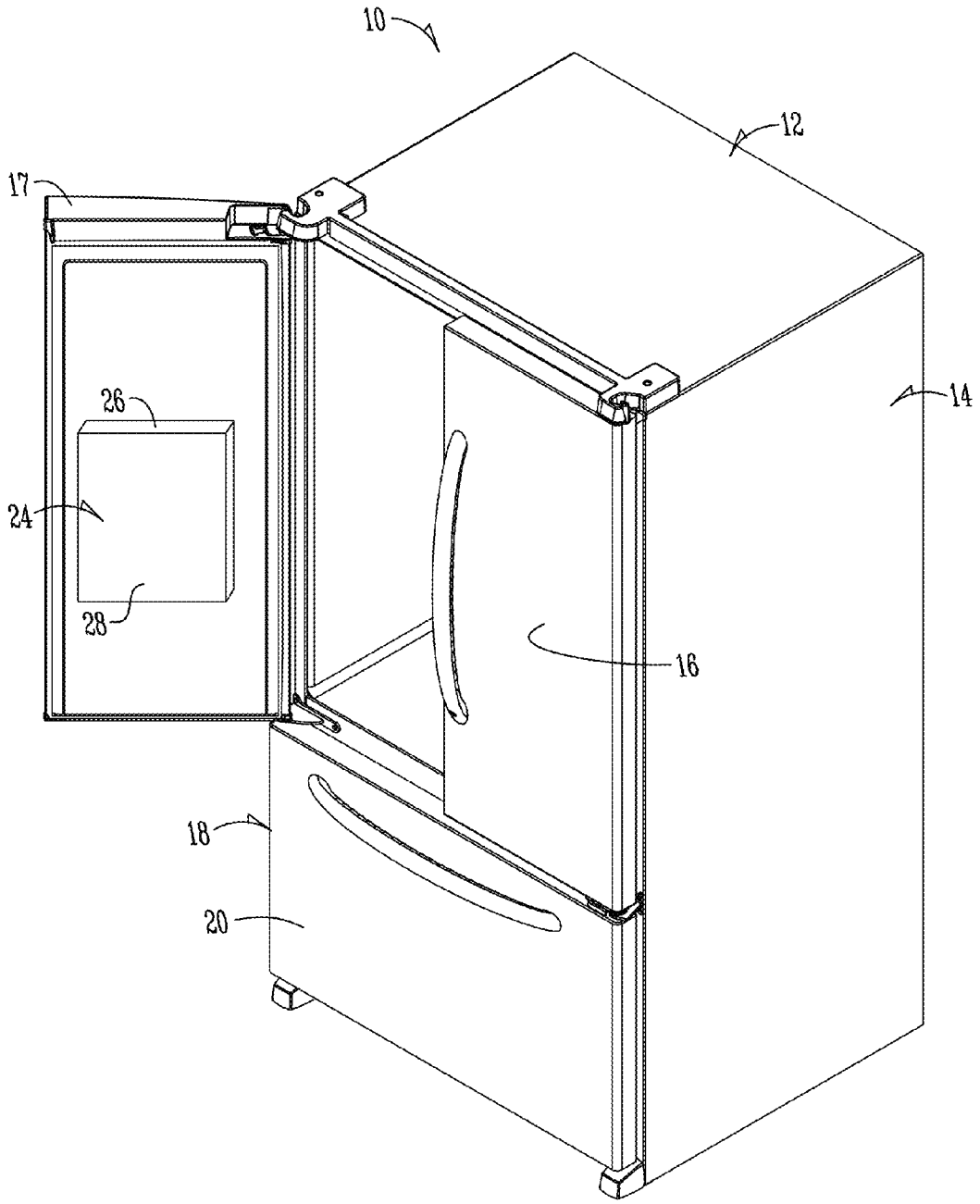
FIG. 2 is a perspective view of the refrigerator of FIG. 1 showing the internal compartments of the refrigerator.

FIG. 2 is a perspective view of the refrigerator 10 of FIG. 1 showing one of the fresh food doors 17 open to show the interior of the door 17, as well as the interior of the refrigerator compartment 14. Positioned at the interior of the door 17 is an ice maker 24. The ice maker 24 shown in FIG. 2 comprises a hermetically sealed ice maker compartment 26, including an ice maker housing 28 for housing the internal components of the ice maker 24, as will be discussed below. The ice maker 24 shown in FIG. 2 is a separate compartment than the refrigerator compartment and/or the freezer compartment. In addition, while the ice maker 24 including the ice maker compartment 26 is shown positioned on the interior of the door 17, it should be appreciated that the ice maker compartment 26 may be positioned generally within the refrigerator compartment 14 or freezer compartment 18. As will be discussed, the ice maker 24 comprises a standalone compartment 26 such that it will not use the same cooling source as any of the other compartments of the refrigerator 10.

Figure 3:
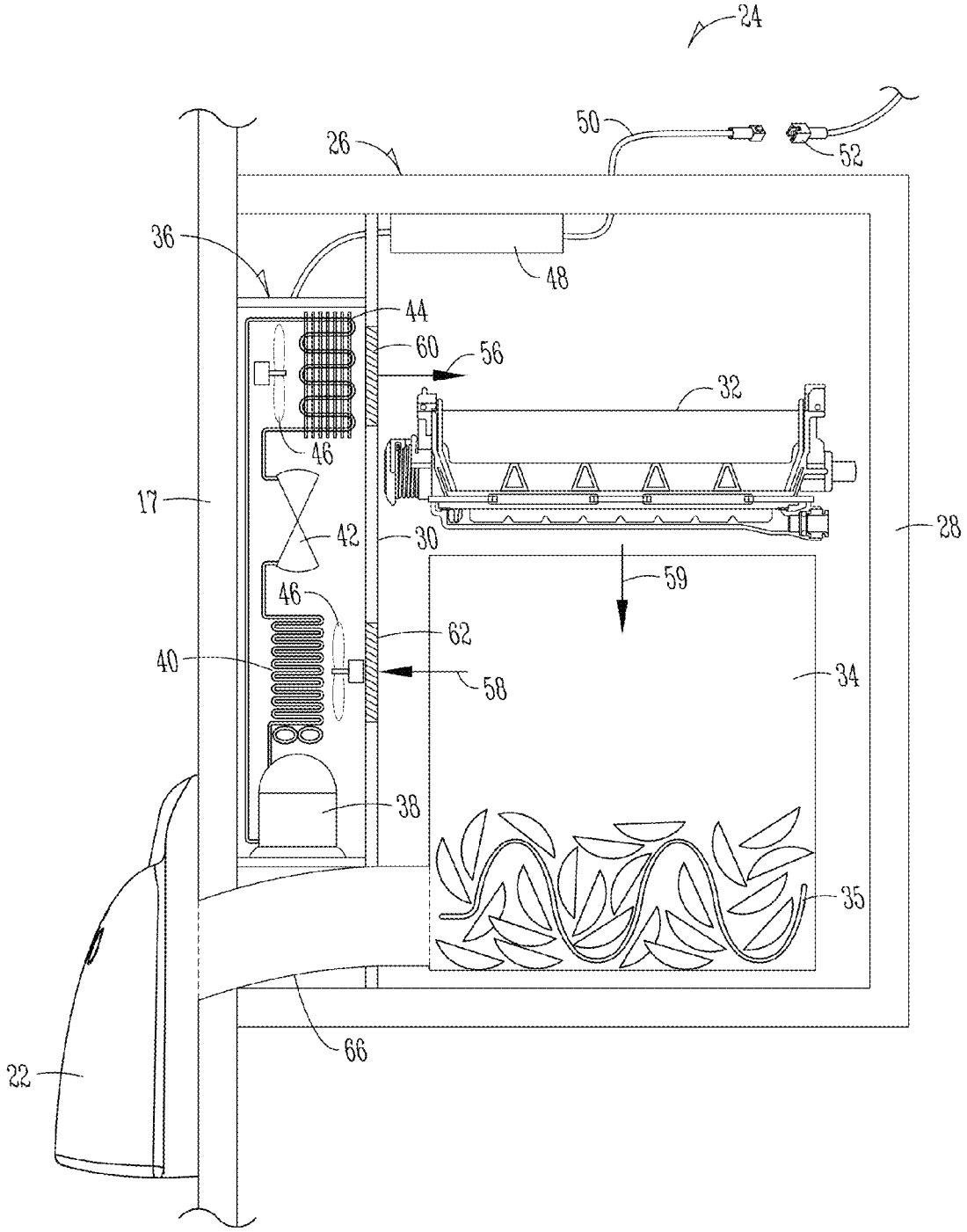
FIG. 3 is a side sectional view of the ice maker compartment of a refrigerator according to an embodiment of the present invention.
Figure 4:
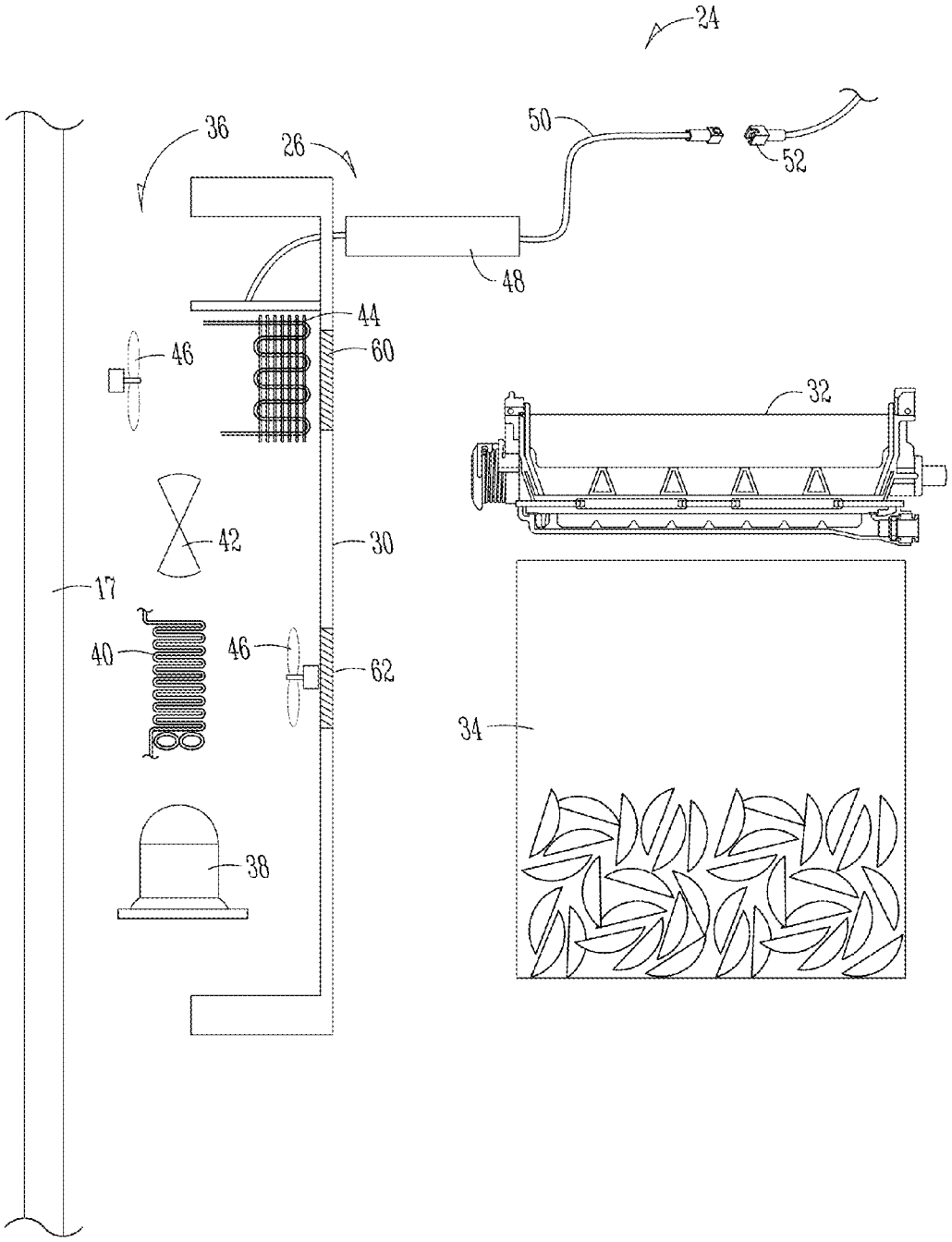
FIG. 4 is an exploded view of the ice maker compartment of FIG. 3.

FIGS. 3 and 4 are a side sectional view and an exploded view of the ice maker compartment 26 showing the various components of the ice maker 24 according to an embodiment of the present invention. As discussed, the ice maker compartment 26 is a separate compartment from the refrigerator compartment 14, freezer 18, or any other compartment associated with the refrigerator 10. Thus, the compartment 26 includes a housing 28 comprising a plurality of walls 30 enclosing the compartment 26. As shown in FIGS. 3 and 4, the housing walls, which may be thermally insulated, may include four components defining a generally rectangular shaped compartment. However, the shape of the compartment is not to limit the present invention. The thermally insulated walls 30 defining the ice maker compartment 26 may then be attached to the interior of the doors 17 to fix the ice maker 24 at the interior of the refrigerator door 17. It should be further appreciated that the thermally insulated walls 30 of the ice maker housing 28 may be hermetically sealed such that they do not allow a substantial amount of cool air therefrom. However, as shown in FIG. 3, at least one of the walls 30 of the ice maker compartment 26 may include an auger 35 and a chute 66 connected to the dispenser 22 such that any ice formed by the ice maker 24 may be dispensed from the ice maker compartment 26 and out the dispenser 22 of the refrigerator 10. In addition, other ways of moving the ice may be also included as part of the present invention, including but not limited to a stirring stick, additional augers, conveyors, or the like.

Furthermore, the ice maker 24 includes an ice tray 32 and a corresponding ice bin 34 housed within the ice maker compartment 26. The ice tray 32 may be any ice tray used for capturing water in a mold or other member and allowing the water to be cooled to form ice therein. The formed ice of the ice tray 32 may be then distributed as in the direction shown by the arrow 59 shown in FIG. 3 towards the ice bin 34. The ice bin 34 is configured to store the formed ice cubes, as well as to provide access for retrieving the formed ice cubes therefrom. As mentioned, the ice bin 34 may include a chute 66 connected to the dispenser 22 for dispensing the formed ice cubes from the ice bin 34 and out the dispenser 22. In addition, the ice maker compartment 26 may include a door, such as a hinged door, sliding door, or the like, such that the ice cubes in the ice bin 34 can be removed. It is further contemplated that the ice bin 34 may be configured in the ice maker compartment 26 such that the ice bin 34 may be completely removed from the ice maker compartment 26 such that the formed ice cubes may be retrieved therefrom. To accomplish the various ways for retrieving ice, the ice maker compartment 26 may include one of the walls 30 to be hingedly connected to the other walls, or may include an insert (not shown) in one of the walls 30 that can be opened to obtain access to the interior of the ice maker compartment 26.

The ice maker 24 of FIGS. 3 and 4 includes its own dedicated ice maker circuit 36. The ice maker circuit 36 may be housed within or at one of the walls 30 of the ice maker compartment 26, and can include a microcompressor 38, a condenser 40, an expansion device 42, and an evaporator 44. A refrigerant can be passed through the circuit to provide a heat transfer area at the evaporator 44 to cool air. The ice maker circuit 36 may also include one or more fans 46 for directing the air through the ice maker circuit as well as through the ice tray 32 and ice bin 34 to cool the water in the ice tray 32 as well as the formed ice cubes in the ice bin 34. Also included in the ice maker 24 may be an intelligent control 48 connected to via electrical connection 50 to a power source 52, a water source 54, as well as the ice maker circuit 36. Thus, the intelligent control 48 housed within the ice maker compartment 26 may indicate when the various applications of the ice maker 24 need to be activated. For example, the intelligent control 48 may indicate to the water source 54 that water needs to be added to the ice tray 32 for cooling to form ice cubes. The intelligent control 48 may also indicate to the ice maker circuit 36 to activate to keep the ice maker compartment 26 at or below a desired temperature, such as freezing temperature, to form the ice cubes and to keep the formed ice cubes from melting or at a temperature slightly above freezing to minimize melting but to keep "clear ice" (i.e. ice that is substantially translucent) substantially clear. As noted, the ice maker 24 includes an electrical connection 50 to a power source 52. The electrical connection may be a series of wires housed within the compartment 26 within the housing walls 30. In the embodiment shown in FIGS. 3 and 4, the power source 52 may be the electrical power of the refrigerator 10 itself. The electrical connection 50 can be connected with the circuitry of the refrigerator 10. Thus, the ice maker 24 will not operate unless the refrigerator 10 is connected to a power source.

In operation, water is added to the ice tray 32 to fill the mold of the ice tray 32. The intelligent control 48 activates the ice maker circuit 36 to cool air by the components of the circuit 36. Fans 46 may be added to the circuit 36 to aid in cooling and directing the cooled air therefrom. The cooled air is then directed in the direction of the arrow 56 and passed over the water in the ice tray 32 to remove heat from the water to cool the water to form ice cubes. Once the cubes have been formed in the ice tray 32, the ice tray then dispenses the formed ice cubes in the direction of the arrow 59 and towards the ice bin 34. The cooled air directed over the ice tray 32 may also pass in the direction of the arrow 59 and through the ice bin 34 to keep the temperature in the ice bin 34 at or below freezing, i.e., at or below 0° Fahrenheit, or at least keep the area about the ice at or below freezing during the ice making process. Additionally, this cooled air may be used to prevent the cubes stored in the ice tray 34 from melting or at least to reduce the melting. The air, which is shown by the arrow 58, has then warmed and can be passed back through the ice maker circuit 36 to re-cool said air to again pass through the ice tray 32 and ice bin 34. As noted, the fans 46 can direct the air from the ice bin 34 and through the ice circuit 36 to pass through the microcompressor 38, condenser 40, expansion device 42, and over the evaporator 44 to re-cool the air.

In addition, the ice maker 24 may also include a plurality of ducts, such as an ice tray duct, ice bin duct, and return duct to allow the air to pass through the ice maker compartment 26 to cool the water, to maintain the temperature of the ices, and then be re-cooled through the ice maker 36.

Thus, the ice maker 24 of FIGS. 3 and 4 allows for a refrigerator to make and maintain ice cubes without utilizing the cooled air of the refrigerator compartment 14 or freezer compartment 18. This will increase the efficiency of the refrigerator 10, as less cooled air will be required to cool the other compartments of the refrigerator. As the ice maker circuit 36 includes a microcompressor 38, along with the other ice maker circuit 36 components, the ice maker circuit 36 will require less energy to run and to use to form and maintain the ice cubes in the ice maker compartment 26. The dedicated, hermetically sealed ice maker 24 also eliminates or mitigates the possibility of external condensation on the back panel of the refrigerator 10, eliminates the air duct and fan that brings the cold air from the freezer compartment 18 to the ice maker water tray, and provides a discharge line of the ice maker 24 that can be used to warm a flipper mullion region, which eliminates the need for an extra electrical heater. These additional benefits will also increase the efficiency of refrigerator 10, thus lowering the energy required for the refrigerator. This in turn lowers the electrical cost for the consumer and/or owner of the refrigerator.

Figure 5:
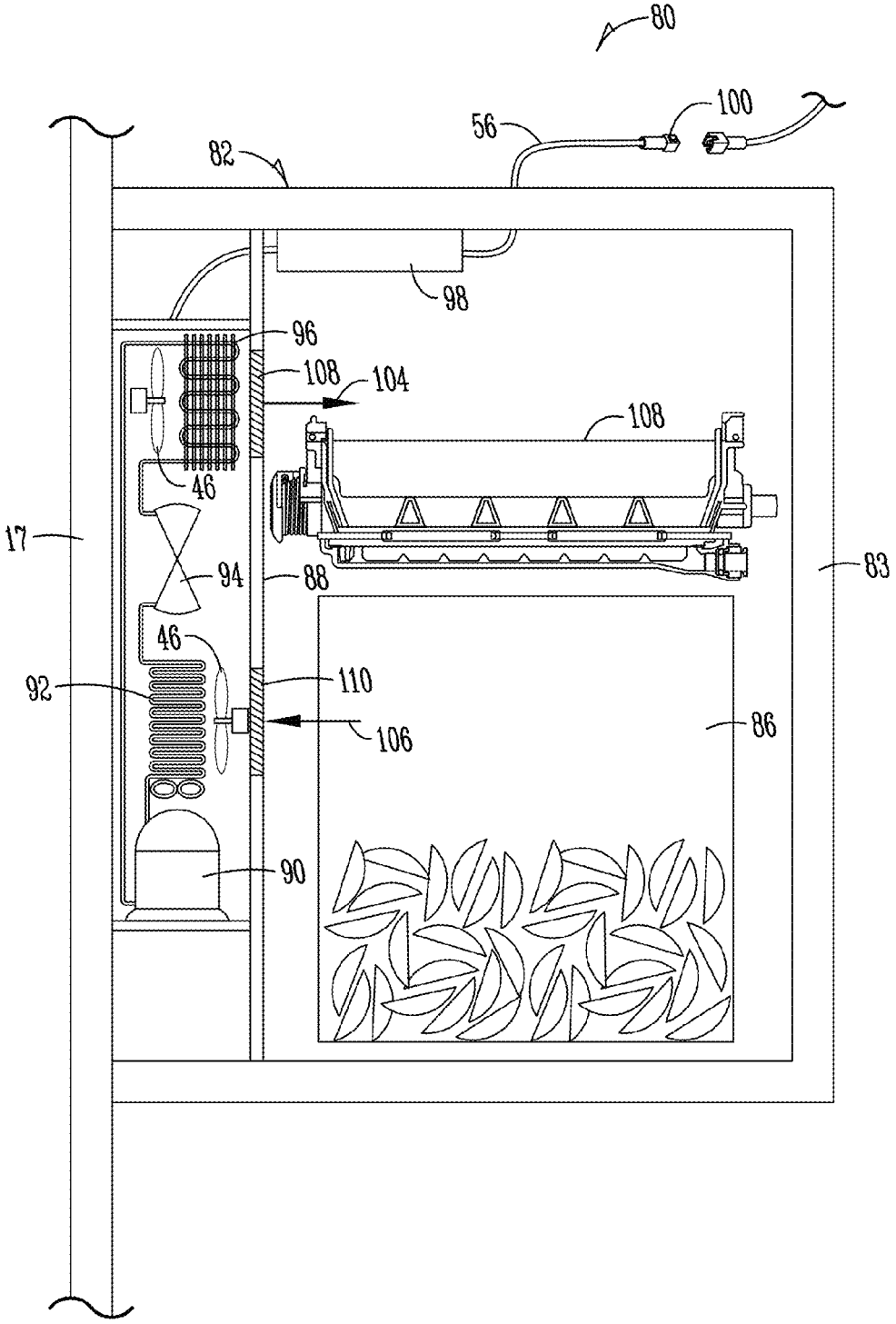
FIG. 5 is a side sectional view of another embodiment of an ice maker compartment according to the present invention.
Figure 6:
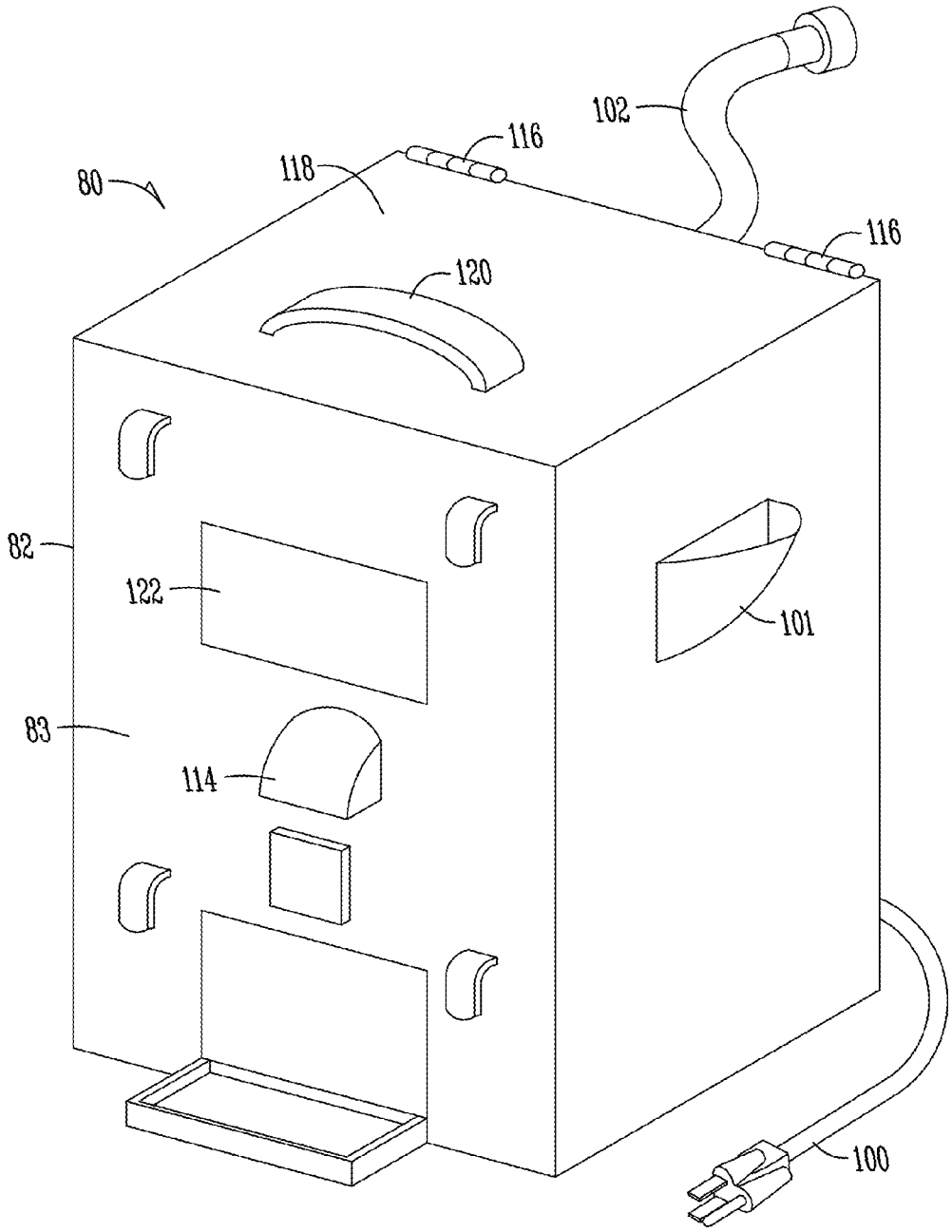
FIG. 6 is a view of the ice maker compartment of FIG. 5 being used outside of the refrigerator.

FIGS. 5 and 6 show an additional embodiment of a hermetically sealed ice maker 80. The ice maker 80 shown in FIGS. 5 and 6 may be considered a modular ice maker. This is because the ice maker 80 shown in FIGS. 5 and 6 may be removed from the refrigerator 10, and can be used in a standalone manner outside of the refrigerator 10. The ice maker 80 is a dedicated, hermetically sealed unit comprising a modular or hermetically sealed housing 82 including a plurality of housing walls 83. The ice maker housing 82 may be attachable to the interior of the refrigerator door 17. For example, hooks, snaps, adhesives, fasteners, or the like may be used to temporarily fix the ice maker 82 the interior of the door 17 of the refrigerator compartment, or any additional interior of the refrigerator 10.

Similar to the ice maker shown in FIGS. 3 and 4, the ice maker 80 shown in FIGS. 5 and 6 includes its own dedicated circuit 88 positioned within a circuit wall 89 of the housing 82. The ice maker 80 also includes an ice tray 84 and corresponding ice bin 86 fluidly coupled to the ice tray 84. The dedicated circuit 88 includes a microcompressor 90, condenser 92, expansion device 94, and evaporator 96 such that the circuit 88 cools air within the ice maker 80 to cool water in the ice tray 84 to form ice which is then dispensed into the ice bin 86, which is also cooled with the cooled air of the circuit 88. A refrigerant can be passed through the circuit 88 to provide a heat transfer region at the evaporator 96 to cool air as it is passed over the evaporator 96. The circuit 88 may also include a plurality of fans 46 to aid in directing the air in the path within the ice maker 80, as well as an intelligent control 98 housed within the ice maker 80 to control operation of the dedicated ice maker 80.

Also shown in FIG. 5 is an electrical connection 100 connected to a power source 52. However, as the ice maker 80 may be considered modular and removable from the refrigerator 10, the power source 52 may not be the refrigerator in all cases. For example, when the ice maker 80 has been removed from the refrigerator 10 and used on a shelf, countertop, or other surface, the electrical connection 100 may be a plugin that is compatible with a standard housing plugin to operate the ice maker 80. However, when the ice maker 80 is housed within the refrigerator 10, the ice maker 80 may still be connected to the refrigerator 10 such that the power source is the refrigerator 10 itself. Likewise, when the ice maker 80 is housed within the refrigerator 10, the water source may be a water line connected to the refrigerator 10. However, when the ice maker 80 is used outside the refrigerator 10, the water source will be different. For example, shown in FIG. 6, the modular ice maker 80 may include a water pour spout 101 that allows water to be poured into the ice tray 84. A water compartment may be included in one of the walls or within the ice maker compartment 80 such that additional water will be stored and automatically added to the ice tray once ice has been formed in the ice tray and dispensed into the bin 86. In addition, the ice maker 80 may include a hose or other connection that is connectable to a sink, spout, or other water source to selectively add water to the ice maker 80 as needed. The present invention is not limiting to a single source of water for the modular ice maker 80 and includes any variation obvious to those in the art.

The ice maker 80 operates similar to that of the ice maker shown in FIGS. 3 and 4. For example, the dedicated circuit 88 for the ice maker 80 is used to cool air for forming ice in the ice tray 84 and maintaining the ice in the ice bin 86 only. It will not be used to cool other parts of the refrigerator or any other appliance. Thus, when the ice maker 80 is used in the refrigerator 10, the ice maker will reduce the amount of energy required for the operation of the refrigerator 10. In addition, the configuration of the circuit 88 will allow the energy required for use of the ice maker outside of the refrigerator 10 to be minimal as well.

Other components that may be optional for the modular ice maker 80 are shown in FIG. 6. For example, the ice maker 80 may include a dispenser 114 for attaching to the ice maker 80. The dispenser 114 will allow a user to dispense ice and/or cooled water from the ice maker 80 outside of the refrigerator 10. The ice maker 80 may also include a lid 118 connected by one or more hinges 116. The lid 118 and hinges 116 may allow access to within the ice maker compartment 80 to allow a consumer to retrieve formed ice from the ice bin 86. A handle 120 may also be provided with the lid 118 to allow easier access to the interior of the ice maker 80. Furthermore, a user interface 122 may be positioned on one of the walls 83 of the ice maker 80 and connected to the intelligent control, circuit water source, etc. of the ice maker 80. The user interface 122 may allow a consumer to select or program different settings for the ice maker 80. For example, the user may be able to set up a cycle to selectively allow the ice maker 80 to form ice at certain times only. The user may also be able to control the temperature of the ice maker at the user interface 122, the shape of the ice formed by the ice maker 80, the crushing or non-crushing of the formed ice cubes, etc. In addition, the user interface 122 may be included to provide notifications to the consumer, such as when a filter needs to be changed, the temperature inside the ice maker 80, the status of the level of ice in the ice bin 86, or the like. In addition, the user interface may be an optional component and not included on all ice makers 80.

In addition, all embodiments shown and described may be removed from a refrigerator, used in a standalone manner, or moved between appliances or other devices. For example, it is contemplated that the ice maker of the invention be used both in a refrigerator and also in a standalone ice maker, large scale ice maker, and/or commercial ice maker. One example is the use of the ice maker of the present invention with a 50-lb ice making machine. The ice making machine need not be in use at all times. However, when a quantity of ice is desired, the ice maker of the invention could be removed from a refrigerator and place in the ice making machine, and then operated to produce a desired amount of ice. In this instance, the ice making machine would have hook-ups for the electrical and water sources for the ice maker. The ice maker would be used for the sole purpose of filling the ice machine with ice. This could have the benefits of allowing the ice making machine to be selectively operated, which could save a huge amount of energy for a consumer.

In the alternative, the ice maker of the present invention could be added to the ice making machine example of above, with the circuit of the ice maker used to operate the ice making machine. In this instance, the ice making machine would have its own ice making elements, and the circuit of the present invention would provide the cooling cycle to form and maintain the ice of the machine. Again, the circuit of the invention would require less energy to produce the cooled air to form and maintain the ice, which would be a cost benefit for the consumer.

These are but a few examples of the benefits and potential uses of the invention, and are not to be limiting. Other uses for both the ice maker and the circuit are contemplated.

The foregoing description has been presented for purposes of illustration and description. It is not intended to be an exhaustive list or to limit the invention to precise forms disclosed. It is contemplated that other alternative processes and systems obvious to those skilled in the art or considered included in the invention. The description is merely examples of embodiments. Any of the components and location of any of the components may be varied as required for different models of refrigerators, as well as different sizes of ice makers for use within and outside of the refrigerator. In addition, the ice bin may be removable or stationary within the ice maker. It is understood that any other modifications, substitutions, and/or additions may be made, which are within intended spirit scope of the invention. From the foregoing, it can be seen that the present, accomplishes at least all the stated objectives.

What is claimed is:

1. A refrigerator, comprising:

a cabinet;

a fresh food compartment within the cabinet;

a freezer compartment within the cabinet;

an ice maker compartment within either the fresh food compartment or the freezer compartment;

an ice maker mounted in the ice maker compartment, the ice maker comprising an ice tray and an ice bin;

a water source extending at least partially through the cabinet and into the ice maker compartment;

a circuit disposed within the ice maker compartment for cooling the ice maker, the circuit comprising a micro-compressor, condenser, expansion device, and evaporator;

a first fan associated with the circuit to aid in moving air through the ice maker compartment to cool the ice maker; and a second fan associated with the circuit to remove warmed air from the ice maker;

said second fan moving a portion of the warmed air back through the circuit and another portion of the air to heat an element of the ice maker compartment or refrigerator; and wherein the circuit is configured to cool air that is directed through the ice maker compartment such that it can form and maintain formed ice therein.

2. The refrigerator of claim 1 wherein the ice maker compartment further comprises an outer housing to at least partially surround the ice maker.

3. The refrigerator of claim 2 wherein the outer housing comprises a thermally insulated material.

4. The refrigerator of claim 2 wherein the circuit is positioned on a wall of the outer housing.

5. The refrigerator of claim 1 wherein the ice bin comprises an auger and a chute configured to aid in dispensing formed ice from the ice bin.

6. The refrigerator of claim 1 wherein the ice maker compartment further comprises an intelligent control electrically connected to the ice maker and circuit to control the ice making process of the ice maker.

7. The refrigerator of claim 1 wherein the ice bin is at or below 0° Fahrenheit during the ice forming process.

8. The refrigerator of claim 1 wherein the ice maker compartment is removable from the refrigerator.

9. The refrigerator of claim 1 wherein the ice maker compartment is hermetically sealed in the compartment.

10. A refrigerator, comprising:

a refrigerator cabinet;

a door for providing access to a compartment within the refrigerator cabinet;

a modular ice maker compartment mounted on the door, the ice maker compartment comprising a water tray and an ice bin, the ice bin having an auger;

a circuit disposed within the ice maker compartment for cooling the ice maker, the circuit comprising a micro-compressor, condenser, expansion device, and evaporator;

a first fan associated with the circuit to aid in moving air through the ice maker compartment to cool the ice maker; and a second fan associated with the circuit to remove warmed air from the ice maker;

said second fan moving a portion of the warmed air back through the circuit and another portion of the air to heat an element of the ice maker compartment or refrigerator ;and wherein the ice maker compartment is operable both in the refrigerator and outside the refrigerator; and wherein the circuit is configured to cool air that is directed through the ice maker compartment such that it can form and maintain formed ice therein.

11. The refrigerator of claim 10 wherein the modular ice maker compartment further comprises a thermally sealed housing at least partially surrounding the water tray, ice bin, and circuit.

12. The refrigerator of claim 11 wherein the circuit is mounted on a wall of the housing.

13. The refrigerator of claim 10 wherein the ice maker compartment further comprises an intelligent control electrically connected to the ice maker and the circuit to control the operation of the ice maker compartment and circuit.

14. The refrigerator of claim 13 wherein the ice maker compartment further comprises an electrical connection operably connectable to a refrigerator power source to power the ice maker compartment, intelligent control, and circuit.

15. The refrigerator of claim 13 wherein the ice maker compartment is removable from the refrigerator to use at a location external of the refrigerator.

16. The refrigerator of claim 10 wherein the ice maker compartment comprises a hermetically sealed unit.

17. A refrigerator, comprising:

a refrigerator cabinet;

a door for providing access to a compartment within the refrigerator cabinet;

an ice maker compartment mounted in the compartment, the ice maker comprising an ice tray and an ice bin and being hermetically sealed within the compartment;

a circuit disposed within the ice maker compartment for cooling the ice maker, the circuit comprising a microcompressor, condenser, expansion device, and evaporator;

a first fan associated with the circuit to aid in moving air through the ice maker compartment to cool the ice maker; and a second fan associated with the circuit to remove warmed air from the ice maker;

said second fan moving a portion of the warmed air back through the circuit and another portion of the air to heat an element of the ice maker compartment or refrigerator; and wherein the circuit is configured to cool air that is directed through the ice maker compartment such that it can form and maintain formed ice therein.

18. An ice maker, comprising:

an ice maker compartment;

an ice tray and ice bin disposed within the interior of the ice maker compartment;

the ice bin comprising an auger and a. chute configured to aid in dispensing formed ice from the ice bin;

a circuit disposed in the ice maker compartment and comprising a microcompressor, condenser, expansion device, and evaporator;

a first fan associated with the circuit to aid in moving air through the ice maker compartment to cool the ice maker; and a second fan associated with the circuit to remove warmed air from the ice maker;

said second fan moving a portion of the warmed air back through the circuit and another portion of the air to heat an element of the ice maker compartment or refrigerator; and wherein the circuit is configured to cool air that is directed through the ice maker compartment such that it can form and maintain formed ice therein.

19. The ice maker of claim 18 further comprising an intelligent control disposed within the ice maker compartment and electrically connected to the circuit to control the operation of the circuit.

20. The ice maker of claim 18 wherein the ice maker compartment comprises at least one thermally insulated wall.

21. The ice maker of claim 18 further comprising an electrical connection to connect the ice maker to a power source.

22. The ice maker of claim 21 wherein the power source is a refrigerator and the refrigerator controls at least one function of the ice maker.

23. The ice maker of claim 22 wherein the ice maker is mounted within a compartment of a refrigerator.

* * * * *